US008080948B2

(12) United States Patent
Fukuda

(10) Patent No.: US 8,080,948 B2
(45) Date of Patent: Dec. 20, 2011

(54) APPARATUS AND METHOD FOR TRIMMING AN OUTPUT PARAMETER OF AN ELECTRONIC BALLAST

(75) Inventor: Kenichi Fukuda, Burlington, MA (US)

(73) Assignee: Panasonic Electric Works Co., Ltd., Osaka (JP)

( * ) Notice: Subject to any disclaimer, the term of this patent is extended or adjusted under 35 U.S.C. 154(b) by 359 days.

(21) Appl. No.: 12/113,351

(22) Filed: May 1, 2008

(65) Prior Publication Data

US 2009/0273304 A1 Nov. 5, 2009

(51) Int. Cl.
*H05B 37/02* (2006.01)

(52) U.S. Cl. ..... 315/307; 315/209 R; 315/246

(58) Field of Classification Search ..... 315/209 R, 315/224–226, 246, 291, 307, 308, 310
See application file for complete search history.

(56) References Cited

U.S. PATENT DOCUMENTS

| | | | | |
|---|---|---|---|---|
| 5,117,178 | A * | 5/1992 | Roth | 323/320 |
| 6,198,234 | B1 * | 3/2001 | Henry | 315/291 |
| 7,075,254 | B2 * | 7/2006 | Chitta et al. | 315/307 |
| 7,622,904 | B2 * | 11/2009 | Sutardja et al. | 323/282 |
| 2002/0047609 | A1 | 4/2002 | Weng | |
| 2002/0140370 | A1 | 10/2002 | Sun | |
| 2002/0190665 | A1 | 12/2002 | Sun | |
| 2007/0063659 | A1 | 3/2007 | Yamashita et al. | |
| 2007/0210723 | A1 | 9/2007 | Kumagai et al. | |
| 2008/0180037 | A1 * | 7/2008 | Srimuang | 315/246 |
| 2009/0273296 | A1 * | 11/2009 | Veskovic et al. | 315/246 |

* cited by examiner

*Primary Examiner* — Thuy Vinh Tran
(74) *Attorney, Agent, or Firm* — Greenblum & Bernstein, P.L.C.

(57) ABSTRACT

An electronic ballast includes a microprocessor which is programmed to read an external voltage value, output a signal which controls an amount of power outputted by the electronic ballast, and adjust the signal based upon a difference between the external voltage value and an internal reference value.

14 Claims, 6 Drawing Sheets

Circuit arrangement in the trimming mode

Schematic diagram in trimming mode

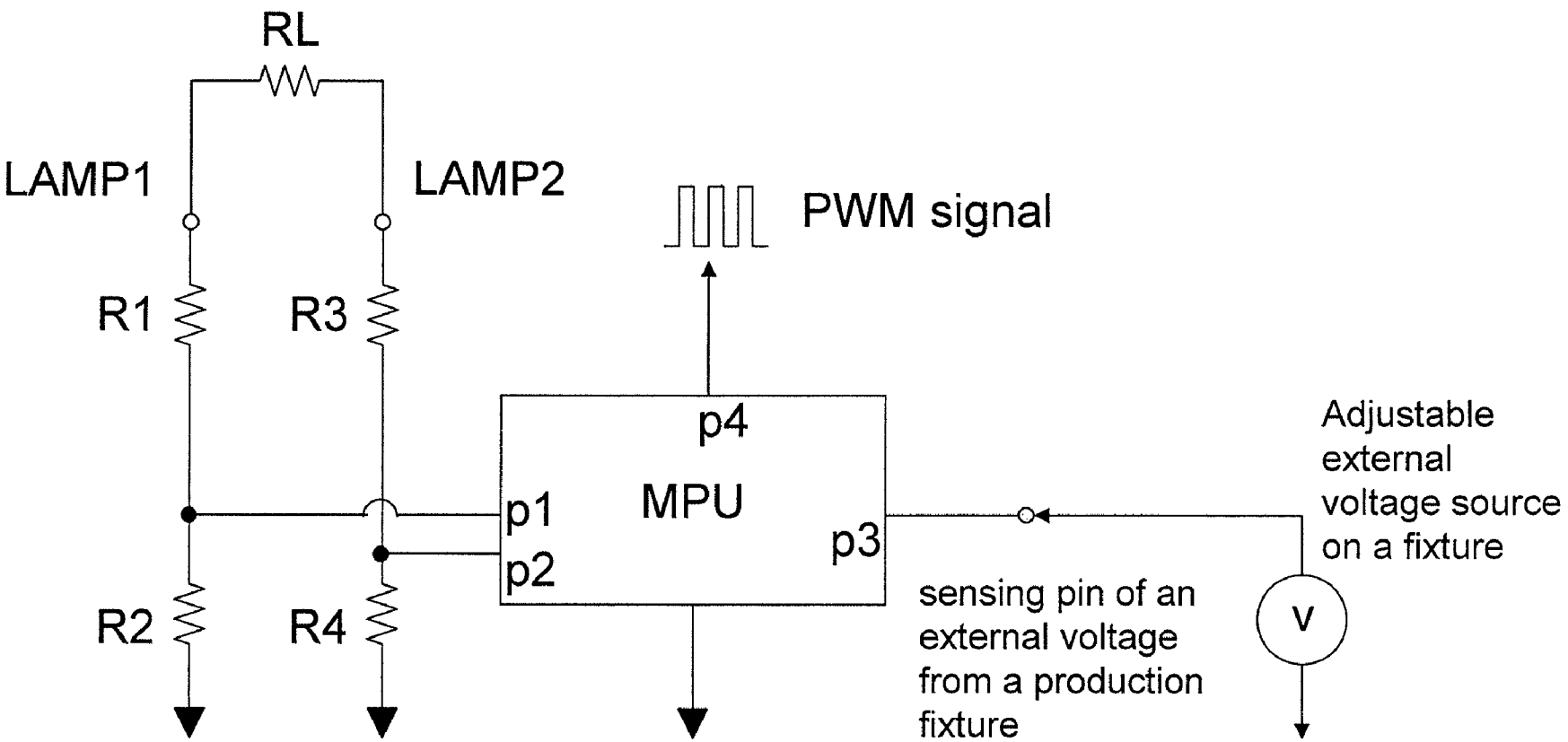
Figure 2A: Circuit arrangement in the trimming mode

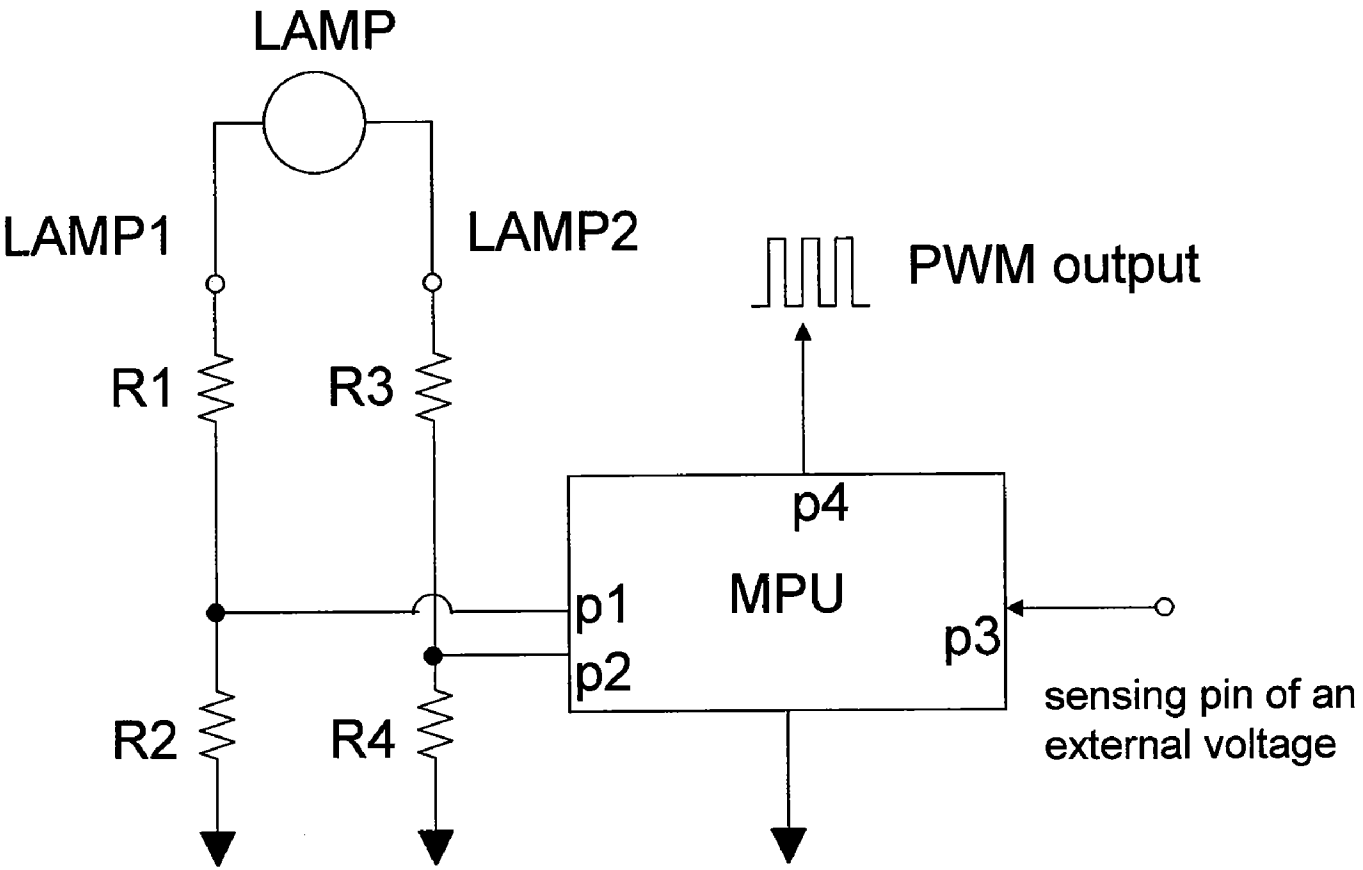
Figure 2B: Circuit arrangement in the normal mode

APPARATUS AND METHOD FOR TRIMMING AN OUTPUT PARAMETER OF AN ELECTRONIC BALLAST

BACKGROUND OF THE INVENTION

1. Field of the Invention

The present invention relates to the field of High Intensity Discharge (HID) lamps, and more particularly, to an electronic ballast of such lamps.

2. Description of the Related Art

FIG. 1A is a schematic diagram of a conventional electronic ballast of an HID lamp. In this ballast, a microprocessor (MPU) reads a scaled down voltage of the HID lamp, and outputs a pulse width modulation (PWM) signal to a power converter switch driver, which drives a power converter switch. The MPU varies the duty cycle of the PWM signal in accordance with the scaled down voltage of the HID lamp, and may set the duty cycle based on values in a lookup table of the MPU, for example. The power converter switch provides power to the HID lamp in accordance with the PWM signal.

The power outputted from the ballast to the HID lamp is a function of the duty cycle of the PWM signal. However, due to component tolerances of the ballast, such as a voltage divider resistor tolerance, a tolerance of an analog to digital converter, a power inductor tolerance, and circuit delay, the output power can widely vary from one ballast to another. For example, the output power of a 70 W ballast can vary between 60 W and 80 W. Thus, the output of the ballast is not only a function of the duty cycle of the PWM signal, but is also a function of the component tolerances.

To minimize the output power variations among ballasts, components with tight tolerances can be used. However, a disadvantage of such a design is the associated increase in cost.

FIG. 1B is a schematic diagram of a second type of conventional electronic ballast of an HID lamp. In this ballast, a MPU does not output a PWM signal directly to a power converter switch driver, as in the ballast shown in FIG. 1A. Instead, the MPU outputs a PWM signal to an input of an operational amplifier The duty cycle of the PWM varies in accordance with the scaled voltage of the HID lamp, and may be set, for example, based on values in a lookup table of the MPU. The second type of the conventional electronic ballast has the same component tolerance issue as the first type of conventional electronic ballast. However, to minimize the output power variation, a potentiometer is connected to a second input of the operational amplifier, and is used to trim the output of the power converter switch.

FIG. 1C is a schematic diagram of the second type of conventional electronic ballast when it is in a trimming mode. To trim the output of the second type of ballast, the ballast output is connected to a fixed resistor, rather than an HID lamp. Typically, the resistance of the resistor corresponds to an HID lamp impedance at a nominal wattage.

An operator measures the output power of the ballast, and turns the potentiometer to trim the output power until he or she determines that it has reached an acceptable value.

A disadvantage of this ballast is that the potentiometer can be adjusted to compensate for error at only one set point, typically the impedance at nominal lamp wattage. However, the lamp impedance is not a constant value during the entire time the lamp is in operation. Thus, the MPU cannot provide an accurate ballast output throughout the entire time the lamp is in operation. Further, the second type of conventional electronic ballast requires the potentiometer to be built into the ballast, which causes the cost of the ballast to increase.

SUMMARY OF THE INVENTION

A feature of the present invention is that it allows an electronic ballast output to be effectively trimmed, without the above-noted drawbacks of the related art.

This may be implemented with an electronic ballast which includes a microprocessor which is programmed to read an external voltage value, output a signal which controls an amount of power outputted by the electronic ballast, and adjust the signal based upon a difference between the external voltage value and an internal reference value.

The external voltage value may be a value of an external voltage which is provided by an external voltage source comprising a power supply and a voltage divider. The microprocessor may be programmed to determine whether to operate in a trimming mode or in a normal mode.

The microprocessor may be programmed to determine whether to operate in the trimming mode or the normal mode based upon the external voltage value. The external voltage value may be a value of an external voltage which is provided by an external voltage source, and the microprocessor may be programmed to operate in the normal mode when the electronic ballast is not connected to the external voltage source. The external voltage value may be a value of an external voltage which is provided by an external voltage source, and the microprocessor may be programmed to operate in the trimming mode when the electronic ballast is connected to the external voltage source.

The microprocessor may be programmed to trim the amount of power outputted by the electronic ballast to a load by adjusting the signal based upon the difference between the external voltage value and the internal reference value, and to store a result of the adjustment, when the microprocessor operates in the trimming mode. The load may be a resistor corresponding to an impedance of a High Intensity Discharge lamp. The microprocessor may be programmed to output a signal which controls an amount of power outputted by the electronic ballast to a High Intensity Discharge lamp in accordance with a voltage corresponding to the electronic ballast output and a result of the adjustment performed in the trimming mode, when the microprocessor operates in the normal mode.

The signal may be a PWM signal. The microprocessor may be programmed to adjust a duty cycle of the PWM signal based upon the difference between the external voltage value and the internal reference value. The microprocessor may be programmed to adjust the duty cycle of the PWM signal by applying a duty cycle offset to a prior duty cycle of the PWM signal. The microprocessor may be programmed to adjust the duty cycle offset based upon the difference between the external voltage value and the internal reference value. The duty cycle offset may be a value representing a percentage, and the microprocessor may be programmed to apply the duty cycle offset by multiplying the duty cycle offset with the prior duty cycle of the PWM signal.

The foregoing and other objects, features, aspects and advantage of the present invention will become more apparent from the following detailed description of the present invention when taken in conjunction with the accompanying drawings.

BRIEF DESCRIPTION OF THE DRAWINGS

FIG. 2A is a circuit drawing of an embodiment of an electronic ballast of the present invention when it is in the trimming mode;

FIG. 2B is a circuit drawing of an embodiment of an electronic ballast of the present invention when it is in the normal mode;

DETAILED DESCRIPTION OF THE INVENTION

Figure 1A:
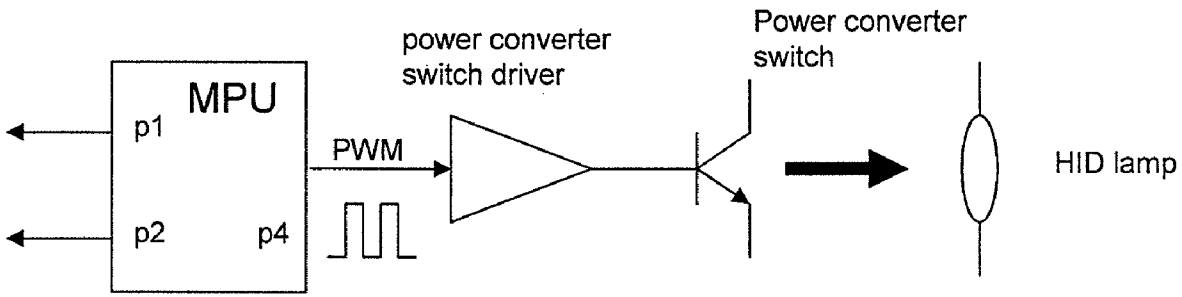
Figure 1A Prior Art
FIG. 1A is a schematic diagram of a first type of conventional electronic ballast of an HID lamp.
Figure 1B:
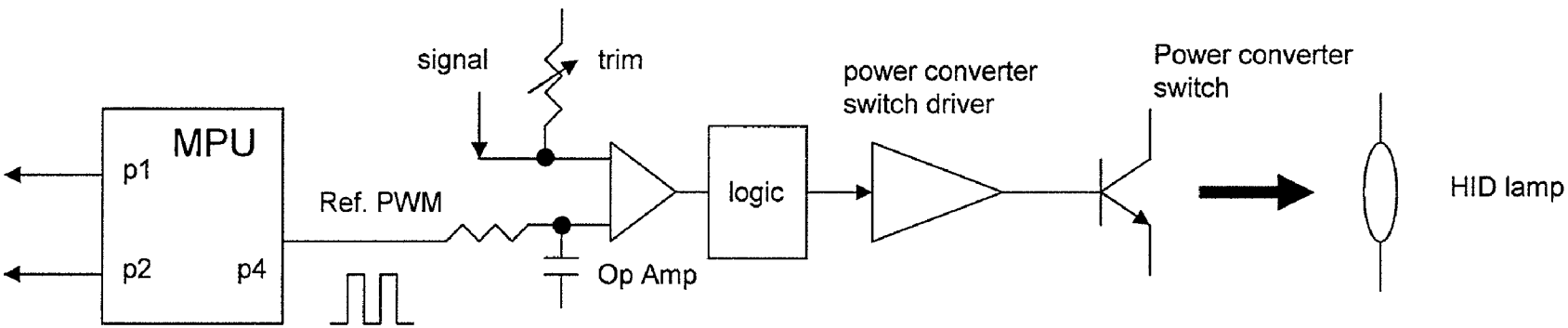
Figure 1B Prior Art
FIG. 1B is a schematic diagram of a second type of conventional electronic ballast of an HID lamp.
Figure 1C:
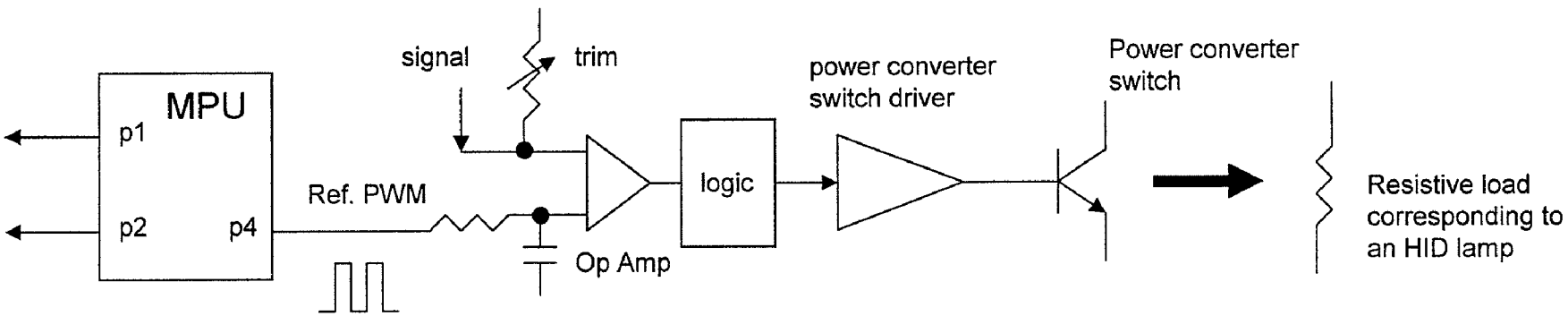
Figure 1C (Prior Art)
FIG. 1C is a schematic diagram of a second type of conventional electronic ballast when it is in the trimming mode.

FIG. 2A is a circuit drawing of an embodiment of an electronic ballast of the present invention when it is in a trimming mode. The trimming mode is to be used during a production process of the electronic ballast. As shown in FIG. 2A, a voltage divider network made up of resistors R1-R4 is connected to output terminals LAMP1 and LAMP2 of the ballast, and a fixed resistor RL is connected across the terminals LAMP1 and LAMP2. The resistance of the resistor RL corresponds approximately to an impedance of an HID lamp at a nominal wattage. A MPU of the ballast includes a sensing pin which receives an external voltage. The external voltage may be provided by an adjustable external voltage source on a production fixture, which generates a specific voltage that causes the MPU to operate in the trimming mode. The external voltage may be read by an analog to digital converter internal to the MPU. The MPU then outputs a PWM signal having an initial duty cycle to cause power to be outputted from the ballast output to the resistor RL. The voltage divider network provides a scaled down voltage value of the ballast output, corresponding to a voltage across the resistor RL, to the MPU. The scaled down voltage value may be read by an analog to digital converter internal to the MPU. Then the MPU generates a PWM signal having a second duty cycle, which may be set, for example, by looking up, in a lookup table of the MPU, an on-width value of the duty cycle which corresponds to the scaled down voltage value. The lookup table may store many numbers representing voltage values of the electronic ballast output. For example, the operating range of the electronic ballast output may vary from A volts to Z volts, and corresponding numbers in the lookup table may vary from a to z.

The adjustable external voltage source is also utilized for adjusting the amount of power outputted by the electronic ballast. The adjustable external voltage source may include, for example, a DC voltage source in the electronic ballast, such as an MPU power supply ($V_{cc}$), and a potentiometer which is connected between the power supply and an MPU ground ($V_{ss}$). The potentiometer supplies a divided DC voltage to the MPU. If the adjustable external voltage source is not provided in the electronic ballast, the potentiometer may be in the production fixture, and supply the divided DC voltage to the MPU only in the trimming mode. A human operator in production reads an output parameter of the electronic ballast, such as an output power to the resistor, and if it is not within a desired range, adjusts the adjustable external voltage source. At the same time, the MPU reads the external voltage value and compares it with an internal reference value. Then, the MPU adjusts the duty cycle of the PWM signal based upon the difference. This can be performed by applying a duty cycle offset to the second duty cycle of the PWM signal. For example, when the external voltage value is higher than the internal reference value, the duty cycle may be increased, when the external voltage value is lower than the internal reference value, the duty cycle may be decreased, and when the external voltage value and the internal reference value are the same, the duty cycle may remain unchanged.

The duty cycle offset may be a variable percentage, which is 100% when the external voltage value is the same as the internal reference value, less than 100% when the external voltage is less than the internal reference value, and more than 100% when the external voltage is more than the internal reference value. The MPU applies the duty cycle offset to the second duty cycle of the PWM signal by multiplying the values together When the duty cycle of the PWM signal is adjusted, this causes the output power of the electronic ballast to change. The human operator reads the output power again and if the output power is still out of the desired range, the human operator adjusts the adjustable external voltage source, and the MPU again adjusts the duty cycle of the PWM signal based upon the difference, for example, by increasing or decreasing the duty offset. This process repeats until the output parameter of the electronic ballast is within the desired range.

When the output power is within the desired range, the MPU stores the final duty cycle offset in a memory, such as an EEPROM.

FIG. 2B is a circuit drawing of an embodiment of an electronic ballast of the present invention when it is in the normal mode. An HID lamp is connected across the terminals LAMP1 and LAMP2. When the sensing pin of the electronic ballast is not connected to an external voltage source, the sensing pin senses a specific voltage, typically a very low voltage, which causes the MPU to operate in the normal mode. The voltage divider network provides a scaled down voltage value of the ballast output, corresponding to a voltage across the HID lamp, to the MPU. The MPU then generates a PWM signal having an adjusted duty cycle which is obtained by applying the stored final duty cycle offset value obtained in the trimming mode to a duty cycle of the PWM signal in accordance with the scaled down voltage of the electronic ballast.

Figure 3A:
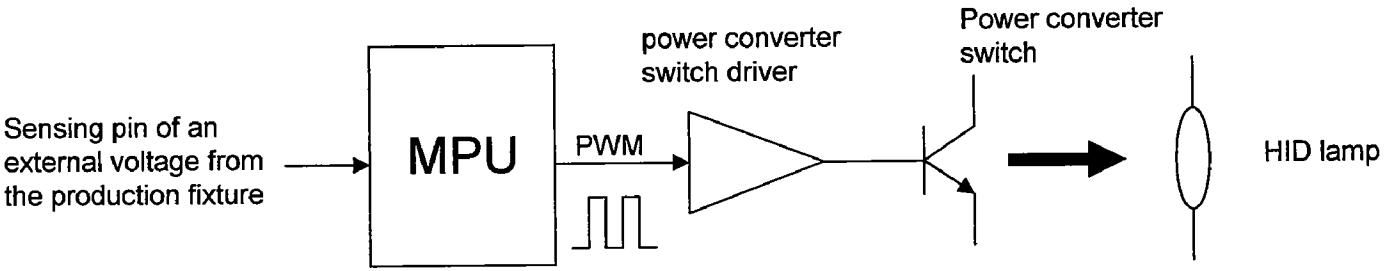
FIGS. 3A and 3B are schematic diagrams of embodiments of an electronic ballast of the present invention.
Figure 3B:
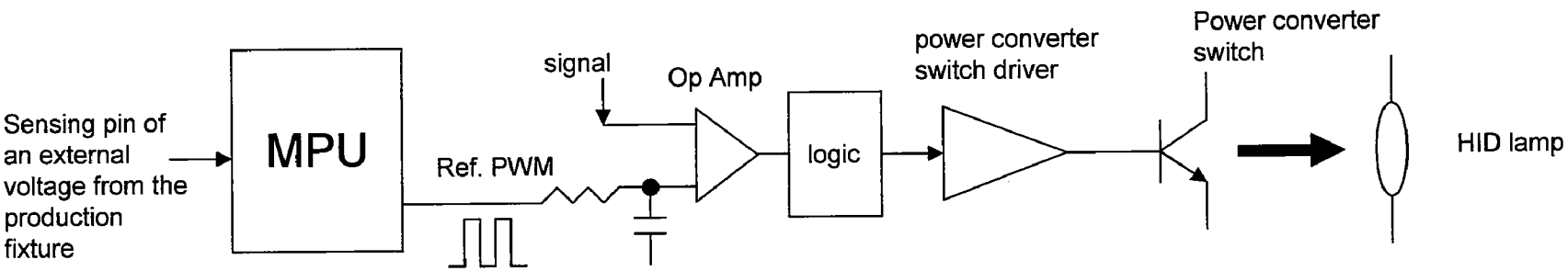

FIGS. 3A and 3B are schematic diagrams of embodiments of a ballast of the present invention. In the ballast shown in FIG. 3A, the MPU outputs the PWM signal directly to a power converter switch driver of the ballast. The power converter switch driver drives a power converter switch to output power via the output terminals LAMP1 and LAMP2. However, in the ballast shown in FIG. 3B, the MPU outputs the PWM signal to analog circuitry, the PWM signal is smoothed by a CR circuit, and then output to an operational amplifier, where it is compared to another input signal. The output of the operational amplifier then controls the power converter switch driver. Both of the ballasts have lookup tables which have a number of values composed of the on-width of the PWM signal.

Figure 4:
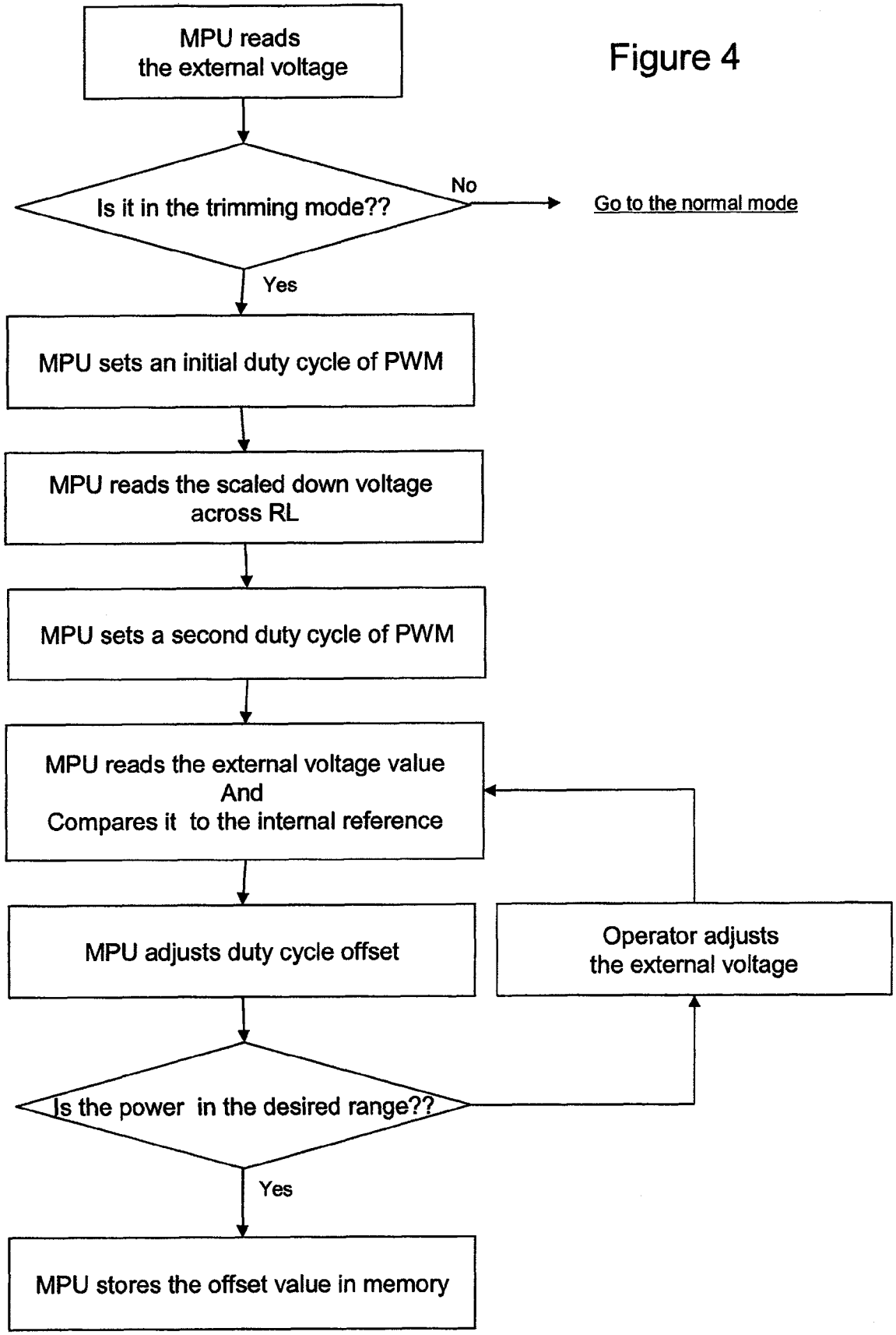
FIG. 4 is a flow chart depicting an embodiment of an algorithm which is performed by the MPU.

FIG. 4 is a flow chart depicting an embodiment of an algorithm which is performed by the MPU during a trimming mode, based upon a program it executes. The algorithm begins with the MPU reading an external voltage value to judge if it is in the trimming mode or in the normal mode. After the MPU judges it is in the trimming mode, the MPU sets an initial duty cycle of the PWM signal and the ballast outputs the power to the resistor RL. Then the MPU reads a scaled down voltage, corresponding to a voltage across the resistor RL. The MPU then sets a second duty cycle of the PWM signal based upon the scaled down voltage. The initial duty cycle of the PWM may be set the same as the second duty cycle of the PWM signal based upon the scaled down voltage.

A human operator reads the output power from the electronic ballast to RL and if the output power is not within the desired range, he or she adjusts the external voltage. The MPU then reads the external voltage again and compares it with the internal reference value. The MPU adjusts the duty cycle of the PWM signal based upon the difference. This can be performed by applying a duty cycle offset to the second duty cycle.

The human operator continues to read the output power and adjusts the external voltage. The MPU also continues to read the external voltage and compare it with the internal reference value and increase or decrease the duty cycle offset depending on the difference between the external voltage and the internal reference value. When the operator accepts that the output power is within the desired range, the adjusted duty cycle of the PWM signal is at a final value, which means the duty cycle offset is also at a final value, and the MPU stores the final duty cycle offset in a memory.

Thus, using the above-described apparatus and method, the ballast output can be effectively trimmed to an acceptable level.

The foregoing embodiments are merely exemplary and are not to be construed as limiting the present invention. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term 'invention' merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specially described herein, will be apparent to those of skill in the art upon reviewing the description.

What is claimed is:

1. An electronic ballast, comprising a microprocessor which is programmed to:

read an external voltage value from an adjustable external voltage source;

output a pulse width modulation (PWM) signal which controls an amount of power outputted by the electronic ballast to a high intensity discharge lamp;

compare the external voltage value to an internal reference value to determine a difference between the external voltage value and the internal reference value; and adjust a duty cycle of the PWM signal based upon the difference between the external voltage value and the internal reference value, so as to adjust the amount of power outputted to the high intensity discharge lamp.

2. An electronic ballast according to claim 1, wherein the external voltage source comprises a power supply and a voltage divider.

3. An electronic ballast according to claim 1, wherein the microprocessor is programmed to determine whether to operate in a trimming mode or in a normal mode.

4. An electronic ballast according to claim 3, wherein the microprocessor is programmed to determine whether to operate in the trimming mode or the normal mode based upon the external voltage value.

5. An electronic ballast according to claim 4, wherein the microprocessor is programmed to operate in the normal mode when the electronic ballast is not connected to the external voltage source.

6. An electronic ballast according to claim 4, wherein the microprocessor is programmed to operate in the trimming mode when the electronic ballast is connected to the external voltage source.

7. An electronic ballast according to claim 3, wherein the microprocessor is programmed to trim the amount of power outputted by the electronic ballast to a load by adjusting the signal based upon the difference between the external voltage value and the internal reference value, and to store a result of the adjustment, when the microprocessor operates in the trimming mode.

8. The electronic ballast according to claim 7, wherein the load comprises a resistor corresponding to an impedance of the high intensity discharge lamp.

9. The electronic ballast according to claim 7, wherein the microprocessor is programmed to output the signal which controls the amount of power outputted by the electronic ballast to the high intensity discharge lamp in accordance with a voltage corresponding to the electronic ballast output and a result of the adjustment performed in the trimming mode, when the microprocessor operates in the normal mode.

10. An electronic ballast according to claim 1, wherein the microprocessor is programmed to adjust the duty cycle of the PWM signal by applying a duty cycle offset to a prior duty cycle of the PWM signal.

11. An electronic ballast according to claim 10, wherein the microprocessor is programmed to adjust the duty cycle offset based upon the difference between the external voltage value and the internal reference value.

12. An electronic ballast according to claim 10, wherein the duty cycle offset is a value representing a percentage, and the microprocessor is programmed to apply the duty cycle offset by multiplying the duty cycle offset with the prior duty cycle of the PWM signal.

13. A method for controlling an electronic ballast, comprising:

reading an external voltage value from an adjustable external voltage source, by a microprocessor;

outputting a pulse width modulation (PWM) signal, from the microprocessor, which controls an amount of power outputted by the electronic ballast to a high intensity discharge lamp;

comparing, by the microprocessor, the external voltage value to an internal reference value to determine a difference between the external voltage value and the internal reference value; and adjusting a duty cycle of the PWM signal, by the microprocessor, based upon the difference between the external voltage value and the internal reference value, so as to adjust the amount of power outputted to the high intensity discharge lamp.

14. A non-transitory computer-readable medium which stores a program which is executed by a microprocessor to control an electronic ballast, the program comprising:

code for reading an external voltage value from an adjustable external voltage source;

code for outputting a pulse width modulation (PWM) signal which controls an amount of power outputted by the electronic ballast to a high intensity discharge lamp;

code for comparing the external voltage value to an internal reference value to determine a difference between the external voltage value and the internal reference value; and code for adjusting a duty cycle of the PWM signal based upon the difference between the external voltage value and the internal reference value, so as to adjust the amount of power outputted to the high intensity discharge lamp.

* * * * *